US010662972B2

(12) United States Patent
Baer et al.

(10) Patent No.: US 10,662,972 B2
(45) Date of Patent: May 26, 2020

(54) CONNECTING ELEMENT

(71) Applicant: ebm-papst Mulfingen GmbH & Co. KG, Mulfingen (DE)

(72) Inventors: Martin Baer, Mulfingen (DE); Erhard Gruber, Satteldorf (DE); Oliver Haaf, Kupferzell (DE); Alexander Konzal, Igersheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 117 days.

(21) Appl. No.: 15/928,193

(22) Filed: Mar. 22, 2018

(65) Prior Publication Data

US 2018/0274549 A1 Sep. 27, 2018

(30) Foreign Application Priority Data

Mar. 23, 2017 (DE) ..... 10 2017 106 233

(51) Int. Cl.

| | |
|---|---|
| ***F04D 29/34*** | (2006.01) |
| ***F04D 29/32*** | (2006.01) |
| ***F04D 29/64*** | (2006.01) |
| ***F04D 29/38*** | (2006.01) |
| *F04D 19/00* | (2006.01) |

(52) U.S. Cl.

CPC ..... *F04D 29/34* (2013.01); *F04D 29/325* (2013.01); *F04D 29/388* (2013.01); *F04D 29/646* (2013.01); *F04D 19/005* (2013.01); *F05D 2250/292* (2013.01); *F05D 2260/941* (2013.01)

(58) Field of Classification Search

CPC ..... F04D 19/005; F04D 29/325; F04D 29/34; F04D 29/388; F04D 29/646; F05D 2250/292; F05D 2260/941

See application file for complete search history.

(56) References Cited

U.S. PATENT DOCUMENTS 4,636,142 A * 1/1987 Baranski ..... F04D 29/388 416/210 R
4,746,271 A * 5/1988 Wright ..... F04D 29/384 416/132 A (Continued)

FOREIGN PATENT DOCUMENTS

CN 106351873 A 1/2017
DE 39 41 691 A1 7/1990

(Continued)

OTHER PUBLICATIONS

European Search Report dated Aug. 7, 2018 for corresponding EP application No. 18160568.4.

(Continued)

*Primary Examiner* — Igor Kershteyn
(74) *Attorney, Agent, or Firm* — Harness, Dickey & Pierce, P.L.C.

(57) ABSTRACT

A connecting element (1) interacting with a fan blade (50) to transfer torque of a drive to the fan blade (50). An attachment portion (2) connects the connecting element (1) with the fan blade. The attachment portion (2) forms an outer edge portion (4) adjoining the outer contour of the connecting element (1). The attachment portion (2) cross-sectional shape is designed to taper toward the outer edge in at least some portions.

17 Claims, 4 Drawing Sheets

(56) References Cited

U.S. PATENT DOCUMENTS

| | | | | |
|---|---|---|---|---|
| 6,692,233 | B2 * | 2/2004 | Liang | F04D 25/088 403/325 |
| 2003/0185684 | A1 * | 10/2003 | Zhong | F04D 25/088 416/210 R |
| 2003/0231960 | A1 * | 12/2003 | Asada | F04D 29/023 416/210 R |
| 2009/0324413 | A1 * | 12/2009 | Streng | F04D 29/388 416/219 R |
| 2019/0195237 | A1 * | 6/2019 | Rowland | F04D 29/34 |

FOREIGN PATENT DOCUMENTS

| | | |
|---|---|---|
| WO | WO-2010/061195 A1 | 6/2010 |
| WO | WO-2017/063712 | 4/2017 |

OTHER PUBLICATIONS

German Search Report dated Dec. 18, 2018 in corresponding DE application No. 10 2017 106 233.5.
European Office Action (in German) dated Dec. 2, 2019 for corresponding European Application No. 18 160 568.4.

* cited by examiner

CONNECTING ELEMENT

CROSS-REFERENCE TO RELATED APPLICATION

This application claims priority to German Patent Application No. 102017106233.5, filed Mar. 23, 2017. The entire disclosure of the above application is incorporated herein by reference.

FIELD

The disclosure relates to a connecting element for arranging, and functionally interacting with, a fan blade, as well as to a fan blade with the connecting element.

BACKGROUND

The connecting element is able to transfer the torque of a drive, specifically of the rotor of an electric motor, to the fan blades of a fan propeller or blower propeller.

From the state of the art, it is known, for example, to establish the connection between rotor and fan propeller by drilling holes, where connector plates, for example, can be attached with bolts. The drilled holes sometimes are reinforced with sleeves. However, the connecting area between rotor and fan blade is a portion limiting the maximum torque to be applied. Thus, a more stable solution for higher motor outputs is desirable.

SUMMARY

It is the object of the disclosure to provide a solution to increase the torque absorption capacity of the fan blade. Additionally, the maximum long-term load is to be increased.

The object is achieved by a connecting element, interacting with a fan blade to transfer the torque of a drive to the fan blade, comprising an attachment portion connecting the connecting element with the fan blade. The attachment portion forms an outer edge portion adjoining the outer contour of the connecting element. The attachment cross-sectional shape is designed to taper toward the outer edge in at least some portions.

According to the disclosure, a connecting element is proposed for this purpose. It is designed for arranging, and functionally interacting with, a fan blade, to transfer the torque of a drive to the fan blade. The connecting element includes an attachment portion to connect the connecting element with the fan blade. The attachment portion forms an outer edge portion adjoining the outer contour of the connecting element. Its cross-sectional shape is designed to taper toward the outer edge in at least some portions.

The connecting element forms the connection between the drive and the fan blade. It reinforces the fan blade with regards to stiffness and structural strength in the critical connecting area where the torque of the drive has the maximum impact on the fan blade.

The specially designed attachment portion of the connecting element facilitates a less-drastic change in stiffness at the transition from the connecting element to the adjacent fan blade. The connecting portion's cross-sectional shape tapers toward the outer edge. The thickness of the connecting portion gradually decreases toward its outer edges when seen in a cross-sectional side view. This avoids peak stresses.

Another advantage lies in the weight reduction compared to solutions using metal plates. Furthermore, the form of the connecting element can be adjusted as needed, depending on the various impeller designs, purposes and power ranges. Critical areas, with particularly high stress, can simply be reinforced by increasing the thickness of the material.

The connecting element is designed to be inserted into a recess on the fan blade. The outer contour of the connecting element sits flush with the fan blade. Thus, the connecting element is not attached on top of the fan blade, but, when mounted, forms an integral part of the fan blade. This will be described in more detail in the following.

In one advantageous embodiment, the outer edge portion of the connecting element conically tapers, at least in some portions, toward its outer edges. It tapers toward that area of its outer edges that adjoin the fan blade when viewed in a cross-sectional side view. The very outer edge preferably is rounded. In one embodiment, the outer edge portion is shaped conically when viewed in a cross-sectional side view. These forms of the outer edge portion keep the peak stresses particularly low.

In one top view of the connecting element, the outer contour of the attachment portion includes at least one, but preferably multiple, slots or recesses. This saves on material while at the same time increases the length of the hull edges of the attachment portion. Thus, the force transmission and torsion protection are improved between the connecting element and the adjoining fan blade. Preferably, the slots or recesses are of a rounded shape. Thus, the outer contour represents a wave form in a top view.

In one embodiment, the connecting element further includes a connecting portion to connect the connecting element to the drive. At least one protruding stud and/or at least one groove is/are provided on one side of the connecting portion. The studs and/or grooves serve to engage or lock the components when attaching to the drive. The force transmission from the drive to the studs and/or the grooves can be conducted via a plate or a flange of respectively complementary shape, at least in some areas. But solutions with connecting arms or bars between the drive and the connecting element are also possible. The transition area between connecting element and fan blade is enlarged in the connecting element compared to a solution using only studs. Creeping under constant load, which is to be avoided, is prevented.

Advantageous with regard to versatility is a further embodiment where the connecting element includes at least one protruding stud and/or at least one groove on two opposing sides of the connecting portion. In a special embodiment, two protruding studs or two grooves, respectively, are provided on two opposing sides of the connecting portion, which are arranged symmetrically to each other on the two sides of the connecting portion. Providing the studs and/or grooves on both sides ensures the realization of both conveying directions of the fan propeller with one and the same connecting element and, consequently, one and the same fan blade. This reduces the article variations that need to be kept in inventory, and also is more cost efficient.

Furthermore, in one embodiment, the connecting element includes a socket in the connecting portion. The socket completely penetrates the connecting element to receive a fastener, specifically a bolt. When installed, the connecting element and, consequently, the fan blade can be attached to the drive or, respectively, the rotor via, for example, the plate, the flange or the bars with a bolt.

In one exemplary embodiment, the attachment portion of the connecting element is designed with at least one attachment wing extending outward from the connecting portion. It has a thickness that is reduced in its entire area compared to that of the connecting portion. It can be over-molded with adhesive material. The term "attachment wing" expresses that the attachment portion immediately adjoins the connecting portion like a wing and extends from it in the same plane to the side, that is, outwardly.

It is also beneficial that the connecting element is provided as a single part or a single piece in one exemplary embodiment. The connecting element can be die-cast, forged or milled, depending on the respective embodiment. Versions made from plastic also can be realized.

A fan blade with a fastening portion for connecting the fan blade to the drive comprises the previously described connecting element arranged within the fastening portion. The resulting advantages already have been described previously for the connecting element and correspondingly apply to the fan blade.

In one advantageous version of the fan blade, the connecting element is inserted into a recess provided in the fastening portion. It is attached to the fastening portion by molding, such that the connection is load-carrying and/or interlocking. The connecting element therefore is equivalent to an inserted component of the fan blade.

Advantageously, the connecting element is attached to the fastening portion by injection molding. At least the attachment portion of the connecting element is over-molded in such a way that a material connection is created with the fan blade body.

The attachment portion of the connecting element is tapered in its cross-section. The over-molding can be conducted advantageously. Thus, the attachment portion and an area of the connecting portion merge in one plane when the connecting element is in its mounted state. This means that the tapered attachment portion of the connecting element is used as a space for the molding material.

In one version, the fan blade comprises a connecting portion designed to only establish the connection to the drive. The attachment portion is designed to only establish the connection to the fan blade. Thus, a clear separation is made between the connection between the connecting element and fan blade, and between the connecting element and drive/rotor.

Other advantageous further-developed embodiments are described in more detail through the drawings in conjunction with the description of the preferred embodiment.

DRAWINGS

The drawings described herein are for illustrative purposes only of selected embodiments and not all possible implementations, and are not intended to limit the scope of the present disclosure.

DETAILED DESCRIPTION

The figures are schematic examples. Identical reference numbers refer to identical components in all views.

Figure 1:
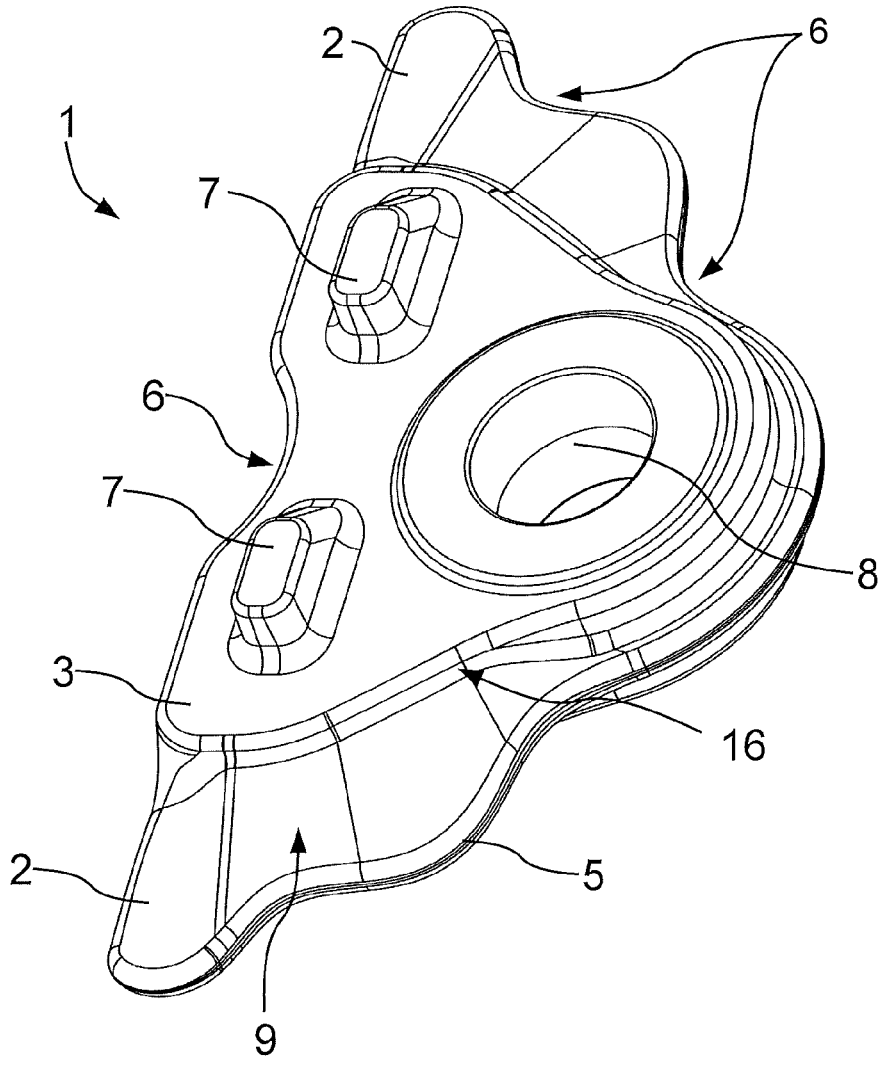
FIG. 1 is a perspective view of a connecting element in a first embodiment.
Figure 2:
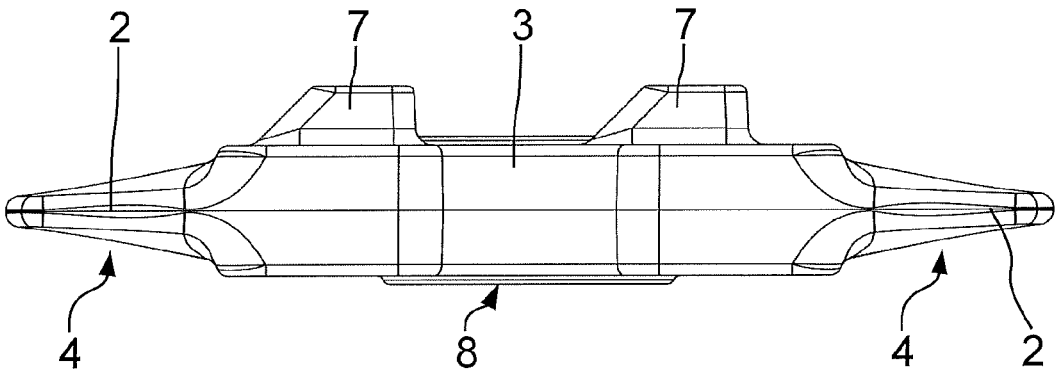
FIG. 2 is a side view of the connecting element shown in FIG. 1.
Figure 6:
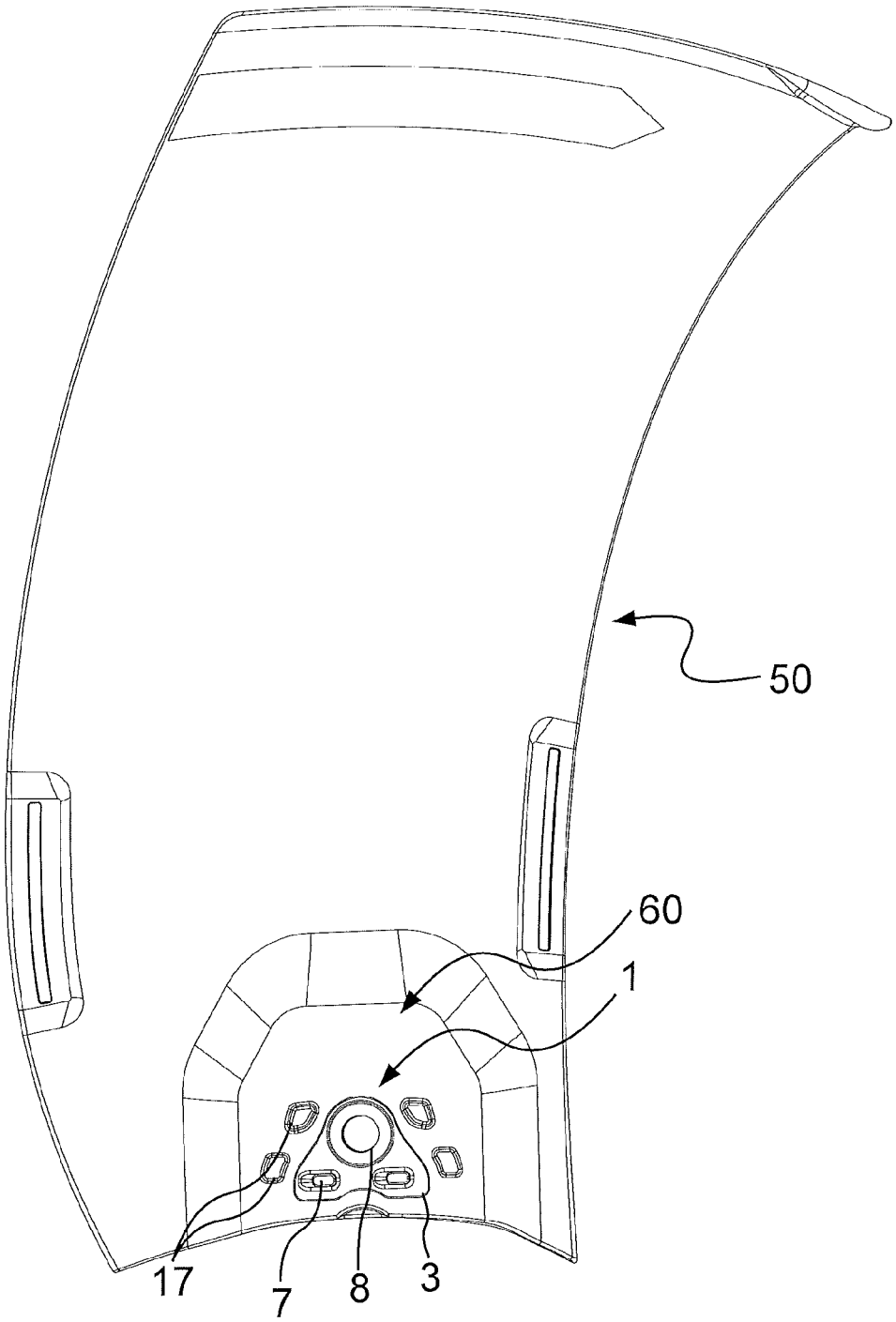
FIG. 6 is a top view of a fan blade with a connecting element according to FIG. 3.

FIGS. 1 and 2 show a perspective and a side view of a connecting element 1 in a first exemplary embodiment, for use with a fan blade 50, as shown in FIG. 6. The connecting element 1 is a single-component body with an essentially triangular basic shape with rounded corners. It includes a central connecting portion 3. An attachment portion 2 extends outward from the connecting portion 3 toward the respective sides to connect the connecting element 1 with the fan blade 50. The transition 16 between the central connecting portion 3 and the attachment portion 2 is rounded and designed without discontinuities. As clearly visible in FIG. 2, the attachment portion 2 forms an outer edge portion 4. The outer edge portion 4 adjoins the outer contour 5 of the connecting element 1. The outer edge portion 4 tapers toward the outer edge on both sides with regard to its thickness and thus in its cross-section. According to the drawing in FIG. 2, the outer edge portion 4 of the attachment portion 2 shows a conical shape in its side view, with straight edges extending outward.

The central connecting portion 3 has a constant thickness. Two spaced-apart studs 7 protrude from one side of the connecting portion. Furthermore, the connecting portion 3 includes a socket 8. The socket 8 completely extends through the connecting portion 3. The socket 8 serves to enable insertion of a fastening bolt (not shown) to attach the fan blade 50 to the drive/rotor.

The shown embodiment is an example of the attachment portion 2 as attachment wings 9, that extend outward from, and directly adjoin, the connecting portion 3. The thickness of the attachment wings 9 is reduced across their entire area compared to the connecting portion 3. The attachment wings 9 are over-molded and form a load-carrying and interlocking connection with the fan blade 50, as shown in FIG. 6. Although only the connecting portion 3 is visible in FIG. 6, the hidden edges of the attachment wings 9 are not outlined. The connecting element 1 then is integrated into the fan blade 50.

The attachment portions 2, designed as attachment wings 9, and the connecting portion 3 include several slots or recesses 6 along the outer contour 5. The slots or recesses 6 point inward. A top view shows a wave shape of the attachment portions 2, which results in increased outer contour length and lower material expenses.

Figure 3:
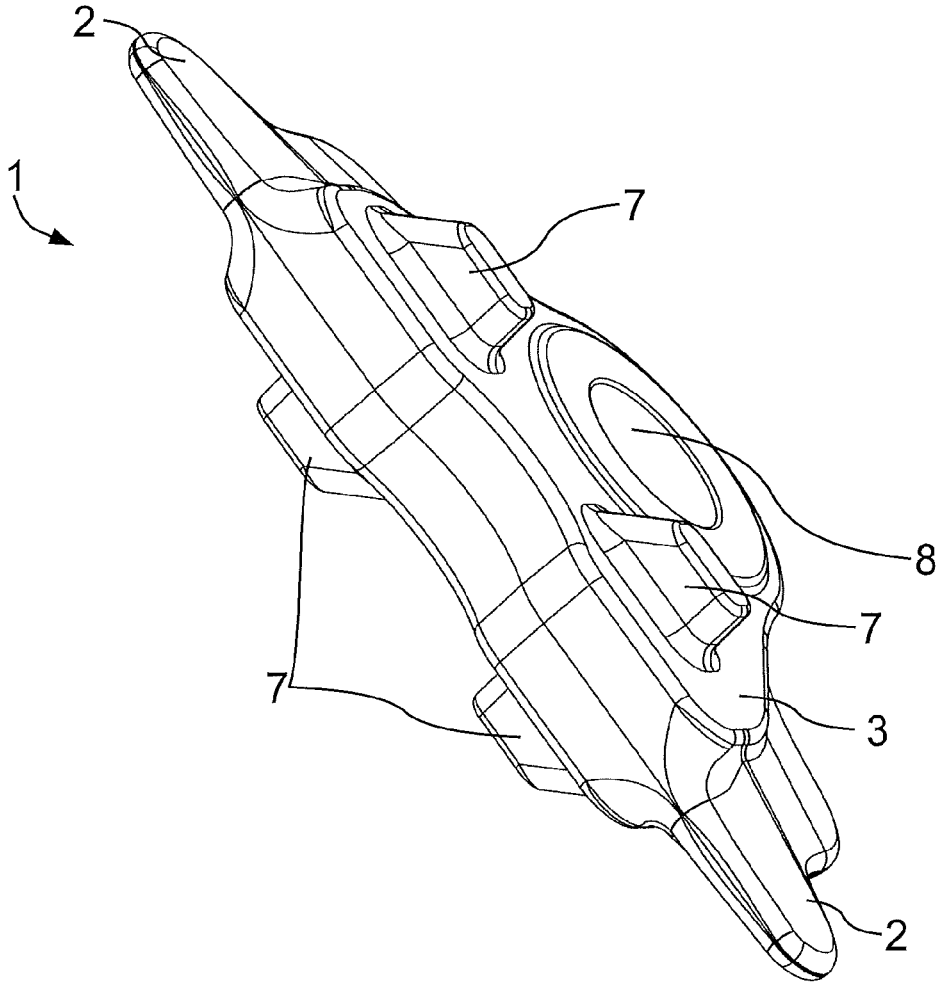
FIG. 3 is a perspective view of a connecting element in a second embodiment.
Figure 4:
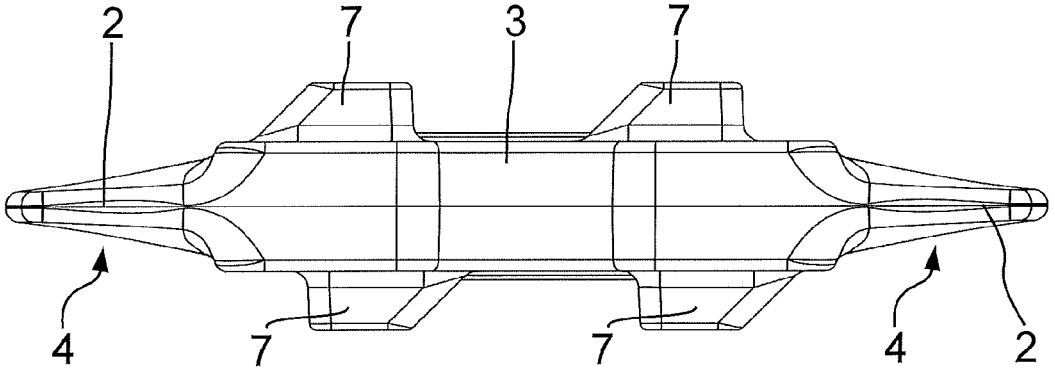
FIG. 4 is a side view of the connecting element shown in FIG. 3.

FIGS. 3 and 4 show a second exemplary embodiment of a connecting element 1 with the same characteristics shown in FIGS. 1 and 2. Additionally, this version includes two studs 7 provided on two opposing sides of the connecting element in a symmetrical arrangement. In an alternative embodiment (not shown), the studs are arranged asymmetrically to each other on the sides of the connecting element.

Figure 5:
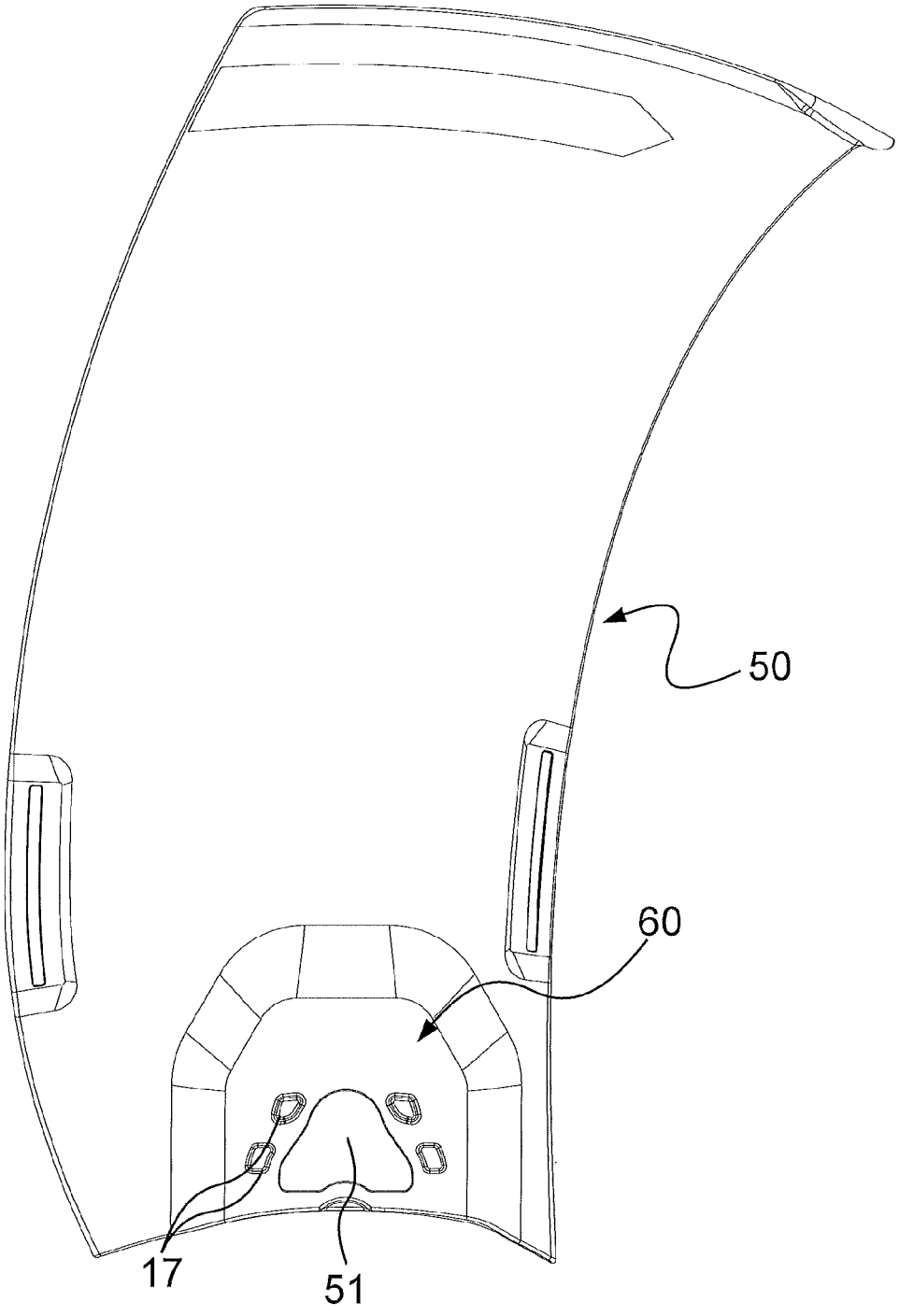
FIG. 5 is a top view of a fan blade without a connecting element.

FIG. 5 shows a fan blade 50 with a fastening portion 60 for attaching the fan blade 50 with the drive or rotor (not shown). A recess 51 is provided in the fastening portion 60. The connecting element 1 is inserted into the recess 51 and connected with the fan blade 50 by injection molding. The attached state is shown in FIG. 6.

The fan blade 50 includes additional recesses 17 in its fastening portion 6 that surround the connecting element 1. This reduces a local material accumulation in the fastening portion 60. Thus, this reduces the cycle time during manufacturing by injection molding process.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connecting element interacting with a fan blade to transfer the torque of a drive to the fan blade comprising:

an attachment portion for connecting the connecting element with the fan blade, the attachment portion forms an outer edge portion adjoining the outer contour of the connecting element, the outer contour of the attachment portion includes at least one recess or slot that point(s) inward, the attachment cross-sectional shape is designed to taper toward the outer edge in at least some portions.

2. The connecting element according to claim 1, wherein the outer edge portion conically tapers, at least in some portions, toward its outer edges in a cross-sectional side view.

3. The connecting element according to claim 1, wherein the outer edge portion is conically shaped in a cross-sectional side view.

4. The connecting element according to claim 1, further comprising a connecting portion for connecting the connecting element to the drive, at least one protruding stud or at least one groove is provided on one side of the connecting portion.

5. The connecting element according to claim 1, wherein the connecting portion includes a socket that completely penetrates the connecting element for inserting a fastener.

6. The connecting element according to claim 1, wherein the connecting element is designed as a one-piece component.

7. The connecting element according to claim 1, wherein the attachment portion is designed with at least one attachment wing extending outward from the connecting portion, the attachment wing has a thickness that is reduced in its entire area compared to that of the connecting portion, the attachment portion can be over-molded with adhesive material.

8. A fan blade with a fastening portion for connecting the fan blade to the drive, wherein a connecting element according to claim 1 is arranged within the fastening portion.

9. The fan blade according to claim 8, wherein the connecting element is inserted into a recess in the fastening portion, and the connecting element is attached to the fastening portion by molding, such that the connection is load-carrying and/or interlocking.

10. The fan blade according to claim 8, wherein the connecting element is inserted into the fastening portion by injection molding, wherein at least the attachment portion of the connecting element is over-molded.

11. The fan blade according to claim 9, wherein the attachment portion and an area of the connecting portion merge in one plane when the connecting element is in its mounted state.

12. The fan blade according to claim 8, wherein the connecting portion is designed to only establish the connection to the drive, and the attachment portion is designed to only establish the connection to the fan blade.

13. The fan blade according to claim 10, wherein the attachment portion and an area of the connecting portion merge in one plane when the connecting element is in its mounted state.

14. The fan blade according to claim 9, wherein the connecting portion is designed to only establish the connection to the drive, and the attachment portion is designed to only establish the connection to the fan blade.

15. The fan blade according to claim 10, wherein the connecting portion is designed to only establish the connection to the drive, and the attachment portion is designed to only establish the connection to the fan blade.

16. A connecting element interacting with a fan blade to transfer the torque of a drive to the fan blade comprising:

an attachment portion for connecting the connecting element with the fan blade, the attachment portion forms an outer edge portion adjoining the outer contour of the connecting element, the attachment cross-sectional shape is designed to taper toward the outer edge in at least some portions; and the connecting element includes at least one protruding stud or at least one groove on two opposing sides of the connecting portion.

17. A connecting element interacting with a fan blade to transfer the torque of a drive to the fan blade comprising:

an attachment portion for connecting the connecting element with the fan blade, the attachment portion forms an outer edge portion adjoining the outer contour of the connecting element, the attachment cross-sectional shape is designed to taper toward the outer edge in at least some portions; and the connecting element includes at least two studs or at least two grooves on two opposing sides of the connecting portion, arranged symmetrically to each other on both sides of the connecting portion.

* * * * *